United States Patent [19]

Peter et al.

[11] Patent Number: 5,036,819

[45] Date of Patent: Aug. 6, 1991

[54] CONTROL SYSTEM FOR THE AIR/FUEL RATIO OF AN INTERNAL COMBUSTION ENGINE

[75] Inventors: Cornelius Peter, Ottersweier; Günther Plapp, Filderstadt; Lothar Raff, Remseck; Eberhard Schnaibel, Hemmingen; Michael Westerdorf, Möglingen, all of Fed. Rep. of Germany

[73] Assignee: Robert Bosch GmbH, Stuttgart, Fed. Rep. of Germany

[21] Appl. No.: 477,976

[22] PCT Filed: Oct. 26, 1988

[86] PCT No.: PCT/DE88/00659

§ 371 Date: Apr. 30, 1990

§ 102(e) Date: Apr. 30, 1990

[87] PCT Pub. No.: WO 89/4424

PCT Pub. Date: May 18, 1989

[30] Foreign Application Priority Data

Nov. 10, 1987 [DE] Fed. Rep. of Germany ..... 3738132

[51] Int. Cl.[5] ..... F02D 41/14

[52] U.S. Cl. ..... 123/489

[58] Field of Search ..... 123/440, 489, 589; 364/431.05, 431.07

[56] References Cited

U.S. PATENT DOCUMENTS

| | | | |
|---|---|---|---|
| 4,594,984 | 6/1986 | Raff et al. | 123/440 |
| 4,601,276 | 7/1986 | Damson et al. | 123/489 |
| 4,741,311 | 5/1988 | Nakajima et al. | 123/489 |
| 4,788,958 | 12/1988 | Nakajima et al. | 123/489 |
| 4,825,838 | 5/1989 | Osuga et al. | 123/489 |
| 4,922,429 | 5/1990 | Nakajima et al. | 123/489 |
| 4,926,826 | 5/1990 | Nakaniwa et al. | 123/489 |

*Primary Examiner*—Willis R. Wolfe

*Attorney, Agent, or Firm*—Walter Ottesen

[57] ABSTRACT

A control system for controlling the air/fuel ratio in an internal combustion engine 10, in which an oxygen probe (lambda probe) 13 is arranged in the exhaust gas of the internal combustion engine 10, has a control device 12 for continuous control. The actual value of the air ratio lambda is determined via a measured probe output voltage in conjunction with an at least approximately predetermined probe-characteristic relationship 16 between the value of the probe output voltage and the value of the air ratio lambda associated therewith. After forming the difference of desired value and actual value of the air ratio lambda, the air/fuel ratio is controlled on the basis of this difference. Such a control system is used primarily in order to reduce the total emission of the main pollutant components of the exhaust gas of an internal combustion engine. In particular in the case of an internal combustion engine 10 with catalytic converter arranged in the exhaust gas, a maintenance of the air ratio lambda as accurate as possible necessary for optimum efficiency of the catalytic converter (lambda=1) is assured.

19 Claims, 1 Drawing Sheet

CONTROL SYSTEM FOR THE AIR/FUEL RATIO OF AN INTERNAL COMBUSTION ENGINE

FIELD OF THE INVENTION

The invention relates to a control system for controlling the air/fuel ratio in an internal combustion engine to an air ratio lambda to be maintained. The control system has an oxygen probe (lambda probe) which is exposed to the exhaust gas of the internal combustion engine and the output voltage of the probe, which represents a measure of the air ratio lambda, changes essentially abruptly in the region of lambda=1.

If a three-way catalytic converter is used for reducing the main pollutant components (NOx, HC, CO) of an internal combustion engine, it is necessary for its optimal efficiency, that is to achieve a maximum conversion rate, that a stoichiometric air/fuel mixture (lambda=1), or at least an air ratio lambda which moves in a certain region around lambda=1 (lambda window), is maintained. In the known control systems, the jump-like response of the output voltage of the lambda probe at the transition from the rich region ($\lambda<1$) to the lean region ($\lambda>1$) and at the transition from the lean region ($\lambda>1$) to the rich region ($\lambda<1$) is evaluated for mixture control, that is, not the value of lambda itself. In this case, the values for the injection time, which are stored in a characteristic field as a function of the speed and load (throttle flap position) of the internal combustion engine, are corrected by means of a two-position control multiplicatively using a correction factor. Usually, a two-position controller with PI action is used for continuous correction of the correction factor. Due to the jump characteristic of the output voltage in the region of lambda=1 and due to existing dead times (transport time of the mixture from the injection valves through the internal combustion engine to the lambda probek, response time of the probe), a control oscillation occurs for the correction factor. The required air ratio lambda can thus only be maintained on average. The amplitude and frequency of this control oscillation significantly influences the exhaust gas emission. An increase in the amplitude of the control oscillation leads to the air ratio lambda temporarily moving outside the lambda window, thereby resulting in a drastic increase in the harmful components of the exhaust gases.

BACKGROUND OF THE INVENTION

From U.S. Pat. No. 4,594,984, a control system is known in which a control device with constant control action is arranged for controlling in the lean region (preferably around lambda=1.2). Since the probe output signal has a relatively small increase in this region, a greater control accuracy is achieved with the continuous-action control device than with the usual two-position control. In the above U.S. Pat. Pat. application, it is also stated that this continuous-action control device cannot be used for a lambda=1 control, since the lambda probe has a steep voltage jump at lambda=1 and, as a result, the control device would always be at the lean or rich limit.

U.S. Pat. No. 4,601,276 discloses a method and apparatus for controlling the air/fuel mixture of an internal combustion engine by means of oxygen probes. The probes are mounted in respective combustion chambers of the engine. This arrangement affords the advantage that the direct measurement of the result of combustion makes possible a very rapid response of the control. The duration of detection of the components of the air/fuel mixture metered to the engine can be considerably reduced. In addition, extreme conditions such as too rich or too lean can be detected after a few cycles of the particular cylinder in question and an appropriate response can be made. The entire engine can be monitored and the measuring results from cylinder to cylinder can be evaluated serially in the ignition sequence. In addition to this, the invention of U.S. Pat. No. 4,601,276 permits the simultaneous monitoring of each individual cylinder. This affords the advantage that variations from cylinder to cylidner in the composition of the mixture can be eliminated. Signals of oxygen probes which are mounted directly in the combustion chambers of an engine can be evaluated for the method and apparatus of U.S. Pat. No. 4,601,276. For this reason, evaluation of the probe signals is undertaken differently than with an oxygen probe mounted in the exhaust of an internal combustion engine, that is, the oxygen probe is continuously subjected to exhaust gases during operation of the engine.

Furthermore, the method and apparatus of U.S. Pat. No. 4,601,276 requires that several oxygen probes also be used in an internal combustion engine having several cylinders and this leads to considerable increased expense.

The invention is based on the object to improve a control system for controlling the air/fuel ratio in an internal combustion engine by means of an oxygen probe mounted in the exhaust system with the oxygen probe being continuously subjected to the exhaust gas of the engine. The control system is improved in with respect to reducing the overall emission of the main pollutant components.

SUMMARY OF THE INVENTION

The solution according to the invention is characterized that the control system according to the invention has a control device for continuous control, in which not, as in the prior art, the jump function response of the output signal of the lambda probe (two-position control) is evaluated for mixture control; but instead, the actual deviation of the air ratio lambda from the air ratio lambda to be maintained is used as system deviation. In this case, the respective actual value of the air ratio lambda is determined via the probe output voltage measured in each case in conjunction with an at least approximately predetermined probe-characteristic relationship between the value of the probe output voltage and the associated value of the air ratio lambda. The desired value of the air ratio lambda corresponding to the air ratio lambda to be maintained is subtracted from the actual value of the air ratio lambda and, with the difference, the air/fuel ratio is controlled.

With the control system according to the invention, deviations from the predetermined air ratio lambda=1 are corrected more quickly than with a usual two-position control system and as a result, the output of harmful exhaust gas components is reduced. According to previous tests, an increase in the control frequency by a factor of 1.5 to 3 compared with the usual two-position control was produced. This contributes both to a reduction in the pollutant emission and improves the smooth running of the internal combustion engine in particular at low speeds and high load. A further advantage of the control system according to the invention in comparison with the two-position control for lambda=1 and which has been known for some time is that the control system according to the invention reacts significantly less sensitively than the usual two-position control to interferences of the probe signal in the event of great cylinder variation (chemical noise). The great cylinder variation has as a consequence that the two-point control, when passing through the control threshold of rich to lean or lean to rich, jumps between the extreme values of lean and rich in each case at increased frequency, which has an unfavorable effect on the emission and performance of the internal combustion engine. By using a control device according to the invention with continuous control action, this switching between two extreme values at increased frequency is avoided.

The control system according to the invention is further characterized by a control device with continuous control in which a probe voltage is used as desired value. The probe voltage is assigned to the particular probe characteristic in correspondence to the air ratio lambda to be maintained. The air ratio difference is determined from the difference of the particular actual values of the measured probe voltage and the desired value of the probe voltage in conjunction with an at least approximately predetermined probe-characteristic relationship between the value of the probe voltage difference and the associated value of the air ratio difference, and the air/fuel ratio is controlled with the air ratio difference. With this control system, the same advantages in comparison with the prior art are achieved in controlling the air/fuel ratio as in the control system according to the invention.

The above advantages of the control system according to the invention only be achieved, however, for a control to lambda=1 if the output voltage of the lambda probe changes only essentially (that is, not in a mathematical ideally abrupt manner) in the region of lambda=1, that is, the output voltage defines a function in the region of lambda=1 having a finite slope. This function interrelates the air ratio lambda and the probe output voltage.

In an advantageous way, the probe-characteristic relationship between probe voltage and air ratio lambda or probe voltage difference and air ratio difference is stored in a characteristic field. According to a further advantageous embodiment of the invention, as input parameters of this characteristic field, on the one hand, the probe voltage or the probe voltage difference is used and, to take into account the temperature-dependent relationship between probe voltage or probe voltage difference and temperature, a temperature-dependent internal probe resistance or the probe temperature itself is used.

In order to save storage space and computing time, it has proved advantageous to reduce this characteristic field to a characteristic curve which is designed for an average or particularly frequently occurring probe temperature.

In order to save storage space, it proves advantageous to reproduce the probe-specific relationship by using mathematical functions, since it has been found particularly advantageous to use a third order parabola as mathematical function if the usual probe characteristic of the lambda probe is used as a basis.

According to a further advantageous development of the invention, a control device is used which has continuous action when controlling to lambda=1 up to a system deviation of preferably 3% (that is lambda=0.97 to lambda=1.03) and the device switches over from continuous-action control to two-position control if the system deviation is greater than 3%. The restriction to a narrow lambda band around the value lambda=1 used for evaluation brings with it the advantage that the influence of errors in the assumed probe characteristic due to temperature changes of the probe is relatively small, since the probe characteristic is rather temperature-stable in the region of lambda=1. Therefore, the accuracy of a zero offset correction of the probe voltage to be carried out can be reduced, since a two-position control is used in the temperature sensitive region outside the lambda band.

In a further advantageous development, the control desired value of the probe voltage $U_S$ is adapted as a function of the measured maximum and minimum probe voltage according to the formula $$U_S=(U_{S(max)}-U_{S(min)})\times K+U_{S(min)}$$

wherein K is a constant factor which is determined on the basis of the probe characteristic. The correction of the control desired value is performed additionally via a low-pass filter. Furthermore, the extreme probe voltage values measured are stored and slowly corrected for the event that no new extreme values of the probe voltage are measured. With this adaptation, it is possible to take into account the shifting of the control desired value of the probe voltage due to aging or temperature change of the probe.

BRIEF DESCRIPTION OF THE DRAWINGS

Embodiments of the invention are illustrated in the drawing and explained in more detail in the following description.

DESCRIPTION OF THE PREFERRED EMBODIMENTS OF THE INVENTION

Figure 1:
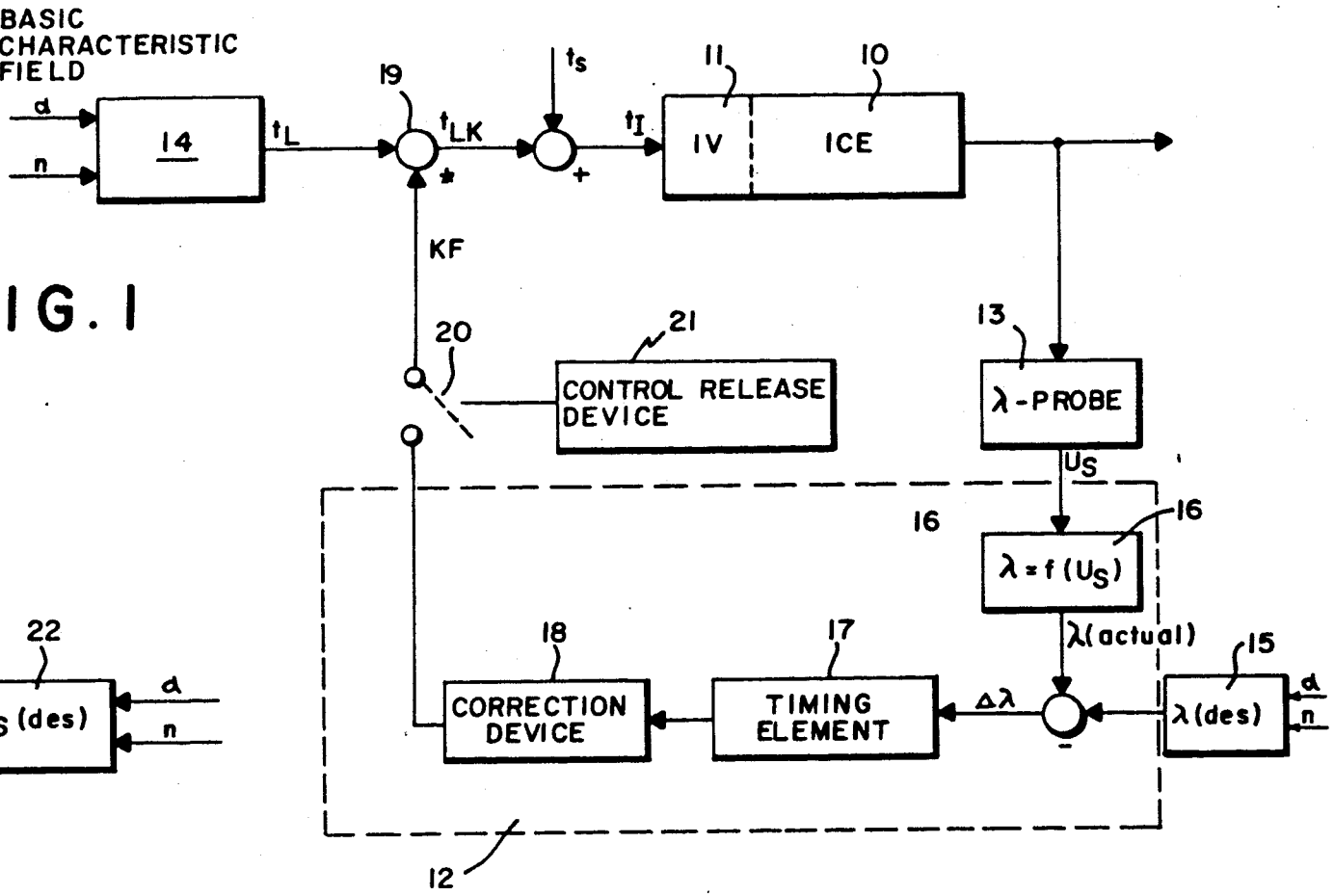
FIG. 1 shows a simplified block circuit diagram of a control arrangement with a control system for controlling the air/fuel ratio in an internal combustion engine according a first embodiment of the invention.

The control arrangement shown in FIG. 1 has an internal combustion engine (ICE) 10 as controlled system with injection valves (IV) 11 as actuators, a control device 12 (outlined in broken lines), a lambda probe 13 arranged in the exhaust gas of the internal combustion engine, and a basic characteristic field 14. The basic characteristic field 14 is preferably designed as a read-only memory (ROM), which is addressed by supplied operating variables (here: speed n and throttle flap position $\alpha$). Dependent on these addresses, a corresponding injection time $t_L$ for the injection valves 11 of the internal combustion engine 10 is read out from the basic characteristic field 14. The lambda probe 13 emits an output signal (output voltage $U_S$) which is supplied to the control device 12. The control device 12 emits as manipulated variable a correction factor KF, which multiplicatively corrects the injection time $t_L$ output from the basic characteristic field 14 and as a result the corrected injection time $t_{LK}$ is produced. Furthermore, the control device 12 is supplied with a control desired value 15 of the air ratio lambda, which may in turn depend on the throttle flap position $\alpha$ and the speed n of the internal combustion engine 10. If a three-way catalytic converter is used, this desired value is set to equal 1 since the existence of a stoichiometric mixture (lambda=1) ensures an optimum conversion performance of the catalytic converter.

The control unit 12 has a conversion device 16, with the aid of which the probe output signals $U_S$ of the lambda probe 13 are converted into lambda values corresponding to the probe-characteristic relationship of lambda value and probe voltage. In order to illustrate the probe-characteristic relationship, either a mathematical function, a table or a characteristic field is used. The probe characteristic is strongly influenced by the probe temperature in the region of greater and smaller lambda=1. In order to increase the control accuracy when determining the lambda value, for example from a characteristic field, it is therefore of advantage to use in addition to the probe voltage $U_S$ the temperature of the probe or the temperature-dependent internal resistance of the probe as input parameters.

Within the control device 12 a timing element 17 is connected downstream of the conversion device 16 and downstream of the timing element 17, a correction device 18 is connected for calculating a correction factor KF. This correction factor KF is supplied to a multiplication unit 19, which multiplies the correction factor KF by the injection time $t_L$ output from the basic characteristic field 14. The output of the correction factor KF can be interrupted by a switch 20, which is switched via a control release device 21. During certain operating phases of the internal combustion engine (for example starting phase, warming-up phase, transient phases), a control to a fixed predetermined air ratio lambda is not desired. In these cases, the output of the correction factor KF is interrupted by the control release device 21 via the switch 20.

When the control release device 21 has released the control, the output signal of the lambda probe arranged in the exhaust of the internal combustion engine 10 is supplied to the conversion device 16. Since the calculation of the correction factor KF is preferably performed by a computer, the analog probe output signal is converted after amplification into a digital signal via an A/D converter (not shown in FIG. 1). The conversion unit 16 calculates from the output signal of the lambda probe 13 the actual value of the air ratio lambda measured in each case, via a predetermined probe-characteristic relationship between output voltage of the probe and air ratio lambda. The comparison carried out subsequently of actual value and desired value 15 of the air ratio lambda leads to a system deviation Δ-lambda, which is supplied to a timing element 17. The timing element subsequently emits a signal to a correction device 18, which carries out the calculation of the correction factor KF.

The correction factor KF is then multiplicatively superimposed on the injection time $t_L$ which is output from the basic characteristic field 14 and as a result the corrected injection time $t_{LK}$ is produced. The addition of the injection time $t_{LK}$ and an injection time $t_S$, which takes into account the dead time influence of the injection valves 11, finally leads to the actual injection time $t_I$. The digitally calculated injection time $t_I$ is passed to an output stage (not shown in FIG. 1) and emitted as analog opening-time signal to the injection valves 11.

Figure 2:
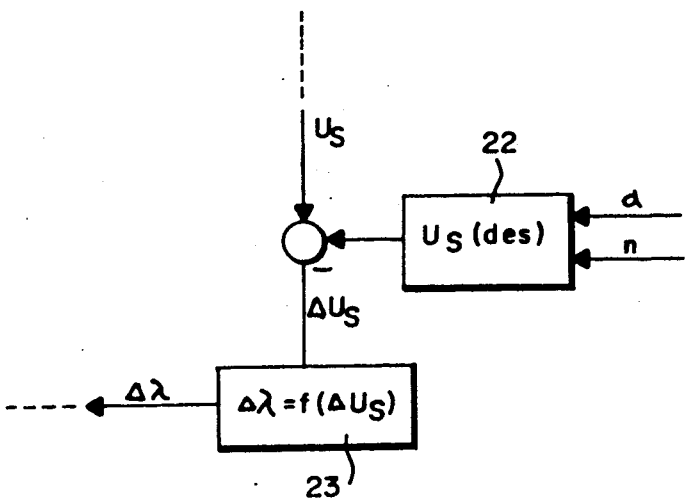
FIG. 2 shows a control arrangement with a control system according to the invention for controlling the air/fuel ratio in an internal combustion engine according to a second embodiment of the invention, wherein, however, not the complete control arrangement is shown but only components in which the control arrangement according to the second embodiment differs from that according to the first embodiment are shown.

The control arrangement shown in FIG. 2 has essentially a similar configuration as the control arrangement of FIG. 1. The same components bear the same reference numerals as in FIG. 1 and are not explained again here. The difference from the control arrangement shown in FIG. 1 is that the system deviation Δ-lambda is determined in a different way. A desired voltage 22 is used as control desired value which again may depend on the throttle flap position $\alpha$ or the speed n.

Furthermore, the control arrangement according to FIG. 2 has a conversion unit 23, which stores the probe-characteristic profile between the probe voltage difference and the air ratio difference associated therewith. After comparison of the actual probe voltage with the desired probe voltage 22, this conversion unit 23 is supplied with a system deviation $\Delta$-$U_S$, from which the system deviation Δ-lambda is calculated. The remainder of the control sequence corresponds to the control sequence of the control arrangement according to FIG. 1, for which reason this is not described again in order to avoid repetitions.

For increasing the control rate, it is particularly advantageous to use a continuous-action controller with PID-action of the timing element 17. For the respective P, I, D components, the system deviation is multiplied by suitable factors, which are stored in dependence upon speed and load in characteristic fields.

An offset in ground potential between probe ground and ground of the analog/digital converter (not shown in the figures) would falsify the result of the measurement of the probe voltage. Therefore, a correction device eliminates this ground offset by measuring the minimum probe voltage established in longer-lasting overrun phases (for example after 800 msec) and storing the difference from the expected minimum value via a filter as correcting quantity for the probe voltages to be measured. To register a negative ground shift, the probe voltage ahead of the analog/digital converter is increased by means of hardware by a fixed voltage value. This elimination of the ground offset leads to a higher accuracy in the registration of the probe output voltage and thus to a higher control accuracy of the continuous-action control device.

This control device serves on the other hand to compensate for a drift in the lean branch of the characteristic curve (raising), for example due to aging. The compensation for the ground offset can, if appropriate, also be performed by using a differential amplifier.

To monitor the converting capability of a catalytic converter, preferably a second lambda probe is arranged downstream of it and this probe emits a signal which has a slight ripple in the signal response around the temperature-stable value lambda=1 when conversion of the exhaust pollutants is at an optimum. A deviation from this temperature-stable point is advantageously used for the offset correction/offset adaptation of the probe output voltage.

We claim:

1. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

a control device for continuously controlling in a control region about lambda equals one, the control device including means for determining the actual value of the air ratio lambda from said output voltage in conjunction with a pregiven probe-characteristic relationship stored in a characteristic field between the value of the probe output voltage and the value of the air ratio lambda associated therewith;

desired value supply means for supplying a desired value of the air ratio lambda corresponding to the air ratio lambda to be maintained;

said control device including means for subtracting said desired value of the air ratio from said actual value of the air ratio lambda to form a difference; and means for controlling the air/fuel ratio on the basis of said difference; and, the probe voltage or the voltage difference and a variable dependent on the temperature of the probe being used as input parameters of the characteristic field.

2. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

a control device for continuously controlling in a control region about lambda equals one, the control device including means for determining the actual value of the air ratio lambda from said output voltage in conjunction with a pregiven probe-characteristic relationship defined by using mathematical functions between the value of the probe output voltage and the value of the air ratio lambda associated therewith;

desired value supply means for supplying a desired value of the air ratio lambda corresponding to the air ratio lambda to be maintained;

said control device including means for subtracting said desired value of the air ratio from said actual value of the air ratio lambda to form a difference; and means for controlling the air/fuel ratio on the basis of said difference; and, wherein a third order parabola is used.

3. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

a control device for continuously controlling in a control region about lambda equals one, the control device including means for determining the actual value of the air ratio lambda from said output voltage in conjunction with a pregiven probe-characteristic relationship between the value of the probe output voltage and the value of the air ratio lambda associated therewith;

desired value supply means for supplying a desired value of the air ratio lambda corresponding to the air ratio lambda to be maintained;

said control device including means for subtracting said desired value of the air ratio from said actual value of the air ratio lambda to form a difference; and means for controlling the air/fuel ratio on the basis of said difference; and, wherein the probe voltage measured is superimposed by an offset correction.

4. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying the output voltage indicative of the air ratio lambda, said output voltage changing abruptly in the region of lambda equals one;

desired value supply means for supplying a voltage as a desired value which is assigned to the air ratio lambda to be maintained and which corresponds to the characteristic of said lambda probe;

a control device for continuously controlling in a control region about lambda equals one, the control device including:

means for determining the air ratio difference from the difference of the measured actual values of said output voltage and the desired value of the probe voltage in conjunction with a pregiven relationship between the value of the voltage difference and the value of the air ratio difference associated therwith;

said control device further including means for controlling the air/fuel ratio on the basis of the air ratio difference;

wherein the probe-characteristic relationship is stored in a characteristic field; and, wherein the probe voltage or the voltage difference and a variable dependent on the temperature of the probe are used as input parameters of the characteristic field.

5. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

desired value supply means for supplying a voltage as a desired value which is assigned to the air ratio lambda to be maintained and which corresponds to the characteristic of said lambda probe;

a control device for continuously controlling in a control region about lambda equals one, the control device including:

means for determining the air ratio difference from the difference of the measured actual values of said output voltage and the desired value of the probe voltage in conjunction with a pregiven relationship between the value of the voltage difference and the value of the air ratio difference associated therewith;

said control device further including means for controlling the air/fuel ratio on the basis of the air ratio difference;

wherein the probe-characteristic relationship is defined by using mathematical functions; and, wherein a third order parabola is used.

6. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

desired value supply means for supplying a voltage as a desired value which is assigned to the air ratio lambda to be maintained and which corresponds to the characteristic of said lambda probe;

a control device for continuously controlling in a control region about lambda equals one, the control device including:

means for determining the air ratio difference from the difference of the measured actual values of said output voltage and the desired value of the probe voltage in conjunction with a pregiven relationship between the value of the voltage difference and the value of the air ratio difference associated therewith;

said control device further including means for controlling the air/fuel ratio on the basis of the air ratio difference, and, wherein the control desired value of the voltage $U_{S(des)}$ is adapted as a function of the measured maximum and minimum probe voltage ($U_{S(max)}$, $U_{S(min)}$) according to the formula $$U_{S(des)}=(U_{S(max)}-U_{S(min)})\times K+U_{S(min)},$$

wherein K is a constant factor which is determined on the basis of the probe characteristic.

7. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said output voltage changing abruptly in the region of lambda equals one;

desired value supply means for supplying a voltage as a desired value which is assigned to the air ratio lambda to be maintained and which corresponds to the characteristic of said lambda probe;

a control device for continuously controlling in a control region about lambda equals one, the control device including:

means for determining the air ratio difference from the difference of the measured actual values of said output voltage and the desired value of the probe voltage in conjunction with a pregiven relationship between the value of the voltage difference and the value of the air ratio difference associated therewith;

said control device further including means for controlling the air/fuel ratio on the basis of the air ratio difference; and, wherein the probe voltage measured is superimposed by an offset correction.

8. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said lambda probe having a characteristic approximating a step function thereby causing said output voltage to change abruptly in the region of lambda equals one;

a control device for continuously controlling in a control region about lambda equals one, the control device including means for determining the actual value of the air ratio lambda from said output voltage in conjunction with a pregiven probe-characteristic relationship between the value of the probe output voltage and the value of the air ratio lambda associated therewith;

desired value supply means for supplying a desired value of the air ratio lambda corresponding to the air ratio lambda to be maintained; and, said control device including means for subtracting said desired value of the air ratio from said actual value of the air ratio lambda to form a control difference; and means for controlling the air/fuel ratio on the basis of said control difference.

9. The control system of claim 8, wherein the probe-characteristic relationship is stored in a characteristic field.

10. The control system of claim 8, wherein the probe-characteristic relationship is defined by using mathematical functions.

11. The control system of claim 8, wherein the control device is configured as a device with continuous PID-action.

12. The control system of claim 8, wherein, when controlling to lambda equals one, the control device has a continuous control action up to a predetermined small control deviation and the control device has a control action corresponding to a two-position control with a greater control deviation, of for example 6%, in the case of a greater control deviation.

13. The control system of claim 12, said predetermined small control deviation being 3%.

14. A control system for controlling the air/fuel ratio in an internal combustion engine to an air ratio lambda which is to be maintained, the control system comprising:

a lambda probe mounted in the exhaust gas system of the engine so as to be continuously exposed to the exhaust gas during the operation of the engine and supplying an output voltage indicative of the air ratio lambda, said lambda probe having a characteristic approximating a step function thereby causing said output voltage to change abruptly in the region of lambda equals one;

desired value supply means for supplying a voltage as a desired value which is assigned to the air ratio lambda to be maintained and which corresponds to the characteristic of said lambda probe;

a control device for continuously controlling in a control region about lambda equals one, the control device including:

means for determining the air ratio difference from the difference of the measured actual values of said output voltage and the desired value of the probe voltage in conjunction with a pregiven relationship between the value of the voltage difference and the value of the air ratio difference associated therewith; and, said control device further including means for controlling the air/fuel ratio on the basis of the air ratio difference.

15. The control system of claim 14, wherein the probe-characteristic relationship is stored in a characteristic field.

16. The control system of claim 14, wherein the probe-characteristic relationship is defined by using mathematical functions.

17. The control system of claim 14, wherein the control device is configured as a device with continuous PID-action.

18. The control system of claim 14, wherein, when controlling to lambda equals one, the control device has a continuous control action up to a predetermined small control deviation and the control device has a control action corresponding to a two-position control with a greater control deviation in the case of a greater control deviation.

19. The control system of claim 18, said predetermined small control deviation being 3% and said greater control deviation begin 6%.

* * * * *

UNITED STATES PATENT AND TRADEMARK OFFICE

CERTIFICATE OF CORRECTION

PATENT NO. : 5,036,819

DATED : August 6, 1991

INVENTOR(S) : Cornelius Peter, Günther Plapp, Lothar Raff, Eberhard Schnaibel and Michael Westerdorf It is certified that error appears in the above-identified patent and that said Letters Patent is hereby corrected as shown below:

In column 1, line 38: delete "probek" and substitute -- probe -- therefor.

In column 1, line 57, delete "Pat. Pat. application" and substitute -- Patent -- therefor.

In column 2, line 13: delete "cylidner" and substitute -- cylinder -- therefor.

In column 2, line 34, delete "in".

In column 2, line 40, between "characterized" and "that", insert -- in --.

In column 3, line 34, between "invention" and "only", insert -- can --.

In column 8, line 18: delete "the" and substitute -- an -- therefor.

UNITED STATES PATENT AND TRADEMARK OFFICE

CERTIFICATE OF CORRECTION

PATENT NO. : 5,036,819

DATED : August 6, 1991

INVENTOR(S) : Cornelius Peter, Günther Plapp, Lothar Raff, Eberhard Schnaibel and Michael Westerdorf It is certified that error appears in the above-identified patent and that said Letters Patent is hereby corrected as shown below:

In column 8, line 34: delete "therwith" and substitute -- therewith -- therefor.

In column 9, line 34: delete "," and substitute -- ; -- therefor.

Signed and Sealed this

Eighteenth Day of May, 1993

*Attest:*

Michael K. Kirk

MICHAEL K. KIRK

*Attesting Officer*

*Acting Commissioner of Patents and Trademarks*